US010934956B2

(12) United States Patent
Kamiji et al.

(10) Patent No.: US 10,934,956 B2
(45) Date of Patent: Mar. 2, 2021

(54) METHOD AND DEVICE FOR CONTROLLING INTERNAL COMBUSTION ENGINE

(71) Applicant: Mazda Motor Corporation, Hiroshima (JP)

(72) Inventors: Taiga Kamiji, Hiroshima (JP); Takuo Hirano, Higashihiroshima (JP); Chikako Ohisa, Aki-gun (JP); Yoshiaki Aritome, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 16/783,986

(22) Filed: Feb. 6, 2020

(65) Prior Publication Data

US 2020/0325841 A1 Oct. 15, 2020

(30) Foreign Application Priority Data

Apr. 11, 2019 (JP) ..... JP2019-075649

(51) Int. Cl.
*F02D 41/14* (2006.01)
*F02D 41/00* (2006.01)

(52) U.S. Cl.
CPC ..... *F02D 41/14* (2013.01); *F02D 41/009* (2013.01); *F02D 2200/0404* (2013.01)

(58) Field of Classification Search
CPC . F02D 41/14; F02D 41/009; F02D 2200/0404
See application file for complete search history.

(56) References Cited

U.S. PATENT DOCUMENTS 6,244,243 B1 * 6/2001 Mamiya ..... F02D 37/02 123/295
2004/0159307 A1 * 8/2004 Ogawa ..... F02D 41/3064 123/295
2005/0288845 A1 * 12/2005 Hirn ..... F02D 41/3064 701/103
2012/0055445 A1 * 3/2012 Kakuya ..... F02D 41/3076 123/305
2017/0298856 A1 * 10/2017 Suzuki ..... F02D 41/0002
2019/0145338 A1 * 5/2019 Tanaka ..... F02B 1/14 60/285

FOREIGN PATENT DOCUMENTS

JP H08177569 A 7/1996

* cited by examiner

*Primary Examiner* — Carl C Staubach
(74) *Attorney, Agent, or Firm* — Alleman Hall Creasman & Tuttle LLP

(57) ABSTRACT

A method for controlling an internal combustion engine is provided, which includes defining a first area in which the engine operates in a stoichiometric combustion mode and a second area in which the engine operates in a lean combustion mode, on an operation map defined by the engine load and speed, and causing a controller to determine that an operation point on the operation map shifts from the first area to the second area based on signals from an accelerator opening sensor and a crank angle sensor, predict a length of time that the operation point stays in the second area, switch a combustion mode to the lean combustion mode when the predicted time is longer than a given period of time, and maintain the stoichiometric combustion mode when the predicted time is shorter than the given period of time.

2 Claims, 11 Drawing Sheets

METHOD AND DEVICE FOR CONTROLLING INTERNAL COMBUSTION ENGINE

TECHNICAL FIELD

The present disclosure relates to a method and device for controlling an internal combustion engine.

BACKGROUND OF THE DISCLOSURE

JP1996-177569A discloses an engine which executes a lean control in which a mixture gas is made leaner than a stoichiometric air-fuel ratio when a throttle opening is smaller than a reference value, and executes a stoichiometric control in which the mixture gas is set to the stoichiometric air-fuel ratio when the throttle opening is larger than the reference value.

Meanwhile, internal combustion engines different from JP1996-177569A, of which an operation map based on an engine load and an engine speed defines an area where the engine operates in a lean combustion mode (lean combustion area) and an area where the engine operates in a stoichiometric combustion mode (stoichiometric combustion area) are known.

With the internal combustion engine of such a configuration, an operation point of the internal combustion engine on the operation map may shift between the lean combustion area and the stoichiometric combustion area, for example when a depression amount of an accelerator pedal by a vehicle driver of an automobile where the internal combustion engine is mounted, frequently changes while the automobile is traveling in an urban area.

When the operation mode of the engine switches between the stoichiometric combustion mode and the lean combustion mode, a state function inside a cylinder (in-cylinder state function) of the internal combustion engine needs to be greatly changed. When the operation point of the internal combustion engine frequently shifts between the lean combustion area and the stoichiometric combustion area as described above, adjustment of the in-cylinder state function may be delayed, which may cause an unstable combustion and degrade fuel efficiency.

SUMMARY OF THE DISCLOSURE

With the art disclosed herein, a combustion mode of an internal combustion engine which switchably operates in a stoichiometric combustion mode and a lean combustion mode is prevented from switching frequently, and degradation of fuel efficiency is prevented.

According to one aspect of the present disclosure, a method for controlling the internal combustion engine is provided.

As a premise of the control method, a first area in which the engine operates in a stoichiometric combustion mode and a second area in which the engine operates in a lean combustion mode are defined on an operation map of the engine defined by an engine load and an engine speed.

The control method includes causing a controller to determine that an operation point of the engine on the operation map shifts from the first area to the second area over a boundary therebetween, based on signals from an accelerator opening sensor and a crank angle sensor, predict a length of time that the operation point stays in the second area, switch a combustion mode of the engine to the lean combustion mode corresponding to the second area when the predicted length of time is longer than a given period of time, and maintain the stoichiometric combustion mode also in the second area when the predicted length of time is shorter than the given period of time.

According to this configuration, when the operation point shifts from the first area to the second area over a boundary therebetween, the controller predicts the length of time that the operation point stays in the second area. Since the operation point does not immediately return from the second area to the first area when the predicted length of time is longer than the given period of time, the controller switches the combustion mode to the lean combustion mode corresponding to the second area.

On the other hand, when the predicted length of time is shorter than the given period of time, there is high possibility of the operation point immediately returning from the second area to the first area. Therefore, the engine does not switch the combustion mode to the lean combustion mode corresponding to the second area, but maintains the stoichiometric combustion mode corresponding to the first area. Thus, even if the operation point immediately returns from the second area to the first area, the combustion mode stays in the stoichiometric combustion mode. Thereby, unstable combustion caused by frequent switching of the combustion mode can be prevented, and degradation of fuel efficiency can be prevented.

While the lean combustion is performable only in a specific operation range to avoid combustion instability, the stoichiometric combustion is fundamentally performable in all operation range of the engine. When there is a possibility that the operation point frequently shifts between the first area and the second area, the stoichiometric combustion mode is maintained so as to stabilize the combustion of the engine, and degradation in fuel efficiency of the engine can be prevented.

The controller may switch the combustion mode to the lean combustion mode when a distance from the operation point in the second area to the boundary is longer than a given value on the operation map, and the controller may maintain the stoichiometric combustion mode when the distance is shorter than the given value on the operation map.

When the distance from the current operation point to the boundary is long on the operation map, the time required for the operation point to shift from the second area to the first area is long. That is, the length of time that the operation point stays in the second area can be predicted to be long. In this case, the controller switches the combustion mode to the lean combustion mode corresponding to the second area to operate the engine. The operation mode is not switched frequently.

On the other hand, when the distance from the current operation point to the boundary is short on the operation map, the operation point may shift from the second area to the first area in an early stage. That is, the length of time that the operation point stays in the second area can be predicted to be short. In this case, the controller prohibits the switching of the combustion mode to the lean combustion mode corresponding to the second area, and maintains the stoichiometric combustion mode corresponding to the first area. The operation mode is not switched frequently.

The controller may switch the combustion mode to the lean combustion mode when a speed of the operation point shifting to the second area over the boundary is lower than a given value on the operation map, and the controller may maintain the stoichiometric combustion mode when the speed exceeds the given value on the operation map.

When the shifting speed of the operation point is low, the time required for the operation point to shift from the second area to the first area is long. That is, the length of time that the operation point stays in the second area can be predicted to be long. In this case, the controller switches the combustion mode to the lean combustion mode corresponding to the second area to operate the engine. The combustion mode is not switched frequently.

On the other hand, when the shifting speed of the operation point is high, the time required for the operation point to shift from the second area to the first area may be short. That is, the length of time that the operation point stays in the second area can be predicted to be short. In this case, the controller prohibits the switching of the combustion mode to the lean combustion mode corresponding to the second area, and maintains the stoichiometric combustion mode corresponding to the first area. The combustion mode is not switched frequently.

The controller may switch the combustion mode to the lean combustion mode when a value obtained by dividing a distance from the operation point in the second area to the boundary by a speed of the operation point shifting to the second area over the boundary is greater than a given value on the operation map, and the controller may maintain the stoichiometric combustion mode when the value is less than the given value on the operation map.

As described above, when the distance from the operation point in the second area to the boundary is greater than the given value on the operation map, the distance from the current operation point to the boundary is long. However, if the shifting speed of the operation point is high, the time required for the operation point to shift from the second area to the first area may be short.

Conversely, even if the distance from the current operation point to the boundary is short on the operation map, if the shifting speed of the operation point is low, the time required for the operation point to shift from the second area to the first area may be long.

Accordingly, when the value obtained by dividing the distance from the operation point to the boundary by the shifting speed of the operation point is greater than the given value on the operation map, the length of time that the operation point stays in the second area can be predicted to be long. In this case, the controller switches the combustion mode to the lean combustion mode corresponding to the second area. When the value is less than the given value, since the length of a staying time may be short, the controller maintains the stoichiometric combustion mode corresponding to the first area. Thus, the mode switching between the lean combustion mode and the stoichiometric combustion mode can be appropriately realized.

According to another aspect of the present disclosure, a control device of an internal combustion engine of which a combustion mode is switched between a stoichiometric combustion mode and a lean combustion mode in which the engine operates at a leaner air-fuel ratio than in the stoichiometric combustion mode, is provided. The control device includes a sensor configured to output a signal related to the operation of the engine, and a controller configured to receive the signal of the sensor, and cause the engine to operate in one of the stoichiometric combustion mode and the lean combustion mode based on an operation point of the engine determined based on the signal of the sensor, and an operation map of the engine defined by an engine load and an engine speed. The controller includes a processor configured to execute a shift determining module, a predicting module, and a combustion mode switching module. The shift determining module determines that the operation point on the operation map shifts from a first area to a second area on the operation map over a boundary therebetween, based on the signal from the sensor, the first area being an area in which the engine operates in the stoichiometric combustion mode on the operation map, and the second area being an area in which the engine operates in the lean combustion mode on the operation map. The predicting module predicts a length of time that the operation point stays in the second area. The combustion mode switching module switches a combustion mode of the engine to the lean combustion mode corresponding to the second area when the predicted length of time is longer than a given period of time, and maintains the stoichiometric combustion mode corresponding to the first area without changing to the lean combustion mode when the predicted length of time is shorter than the given period of time.

The predicting module may predict the length of time that the operation point stays in the second area based on a distance from the operation point of the engine in the second area to the boundary on the operation map. The combustion mode switching module may switch the combustion mode to the lean combustion mode when the distance is longer than a given value, and maintain the stoichiometric combustion mode when the distance is shorter than the given value.

The predicting module may predict the length of time that the operation point stays in the second area based on a speed of the operation point shifting to the second area over the boundary on the operation map. The combustion mode switching module may switch the combustion mode to the lean combustion mode when the speed is lower than a given value, and maintain the stoichiometric combustion mode when the speed exceeds the given value.

The predicting module may predict the length of time that the operation point stays in the second area based on a value obtained by dividing a distance from the operation point in the second area to the boundary by a speed of the operation point shifting to the second area over the boundary on the operation map. The combustion mode switching module may switch the combustion mode to the lean combustion mode when the value is greater than a given value, and maintain the stoichiometric combustion mode when the value is less than the given value.

DETAILED DESCRIPTION OF THE DISCLOSURE

Hereinafter, one embodiment of a control device of an internal combustion engine is described in detail with reference to the accompanying drawings. The following description gives one example of an engine as the internal combustion engine, and the control device of the engine.

Figure 1:
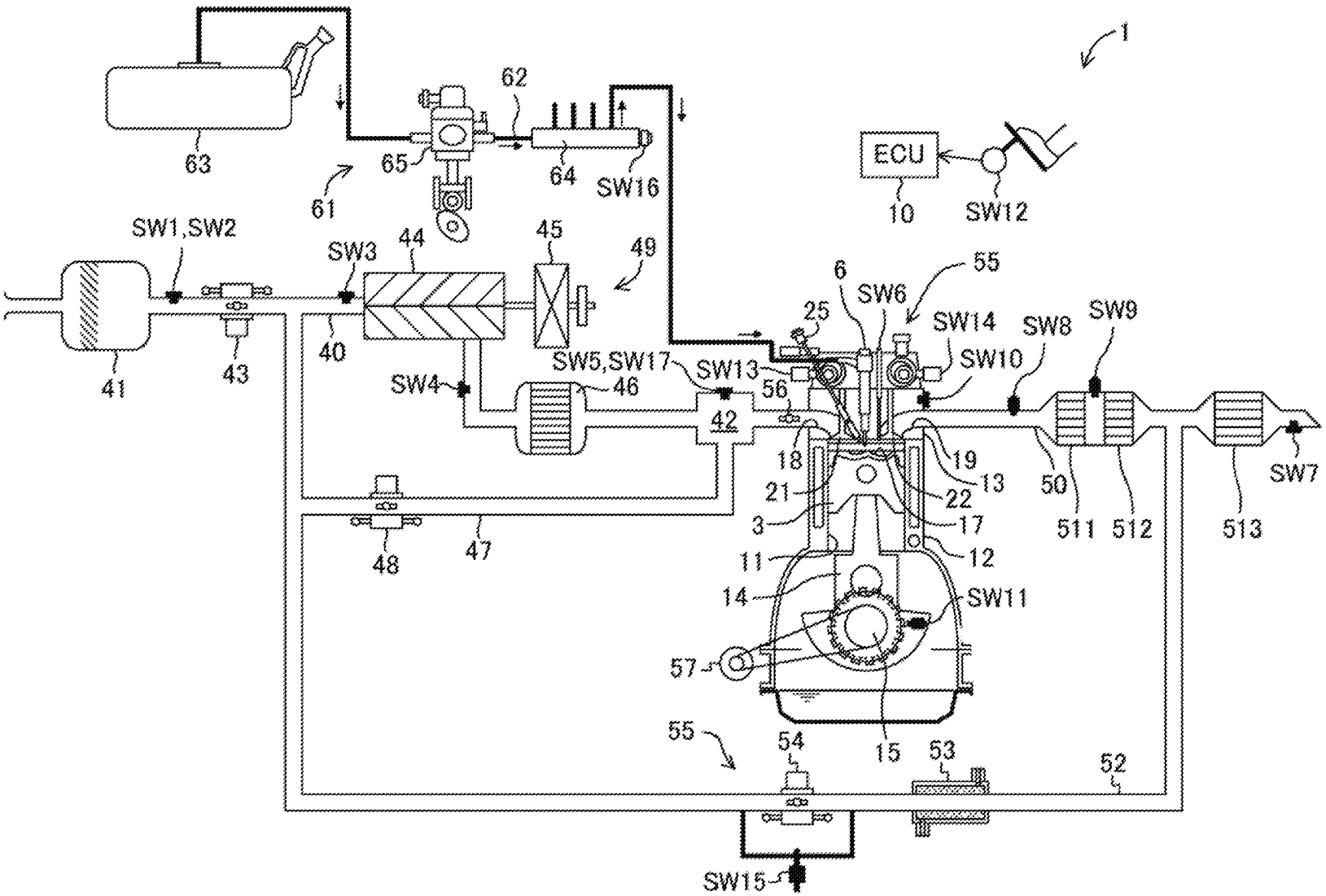
FIG. 1 is a view illustrating a configuration of an engine.
Figure 2:
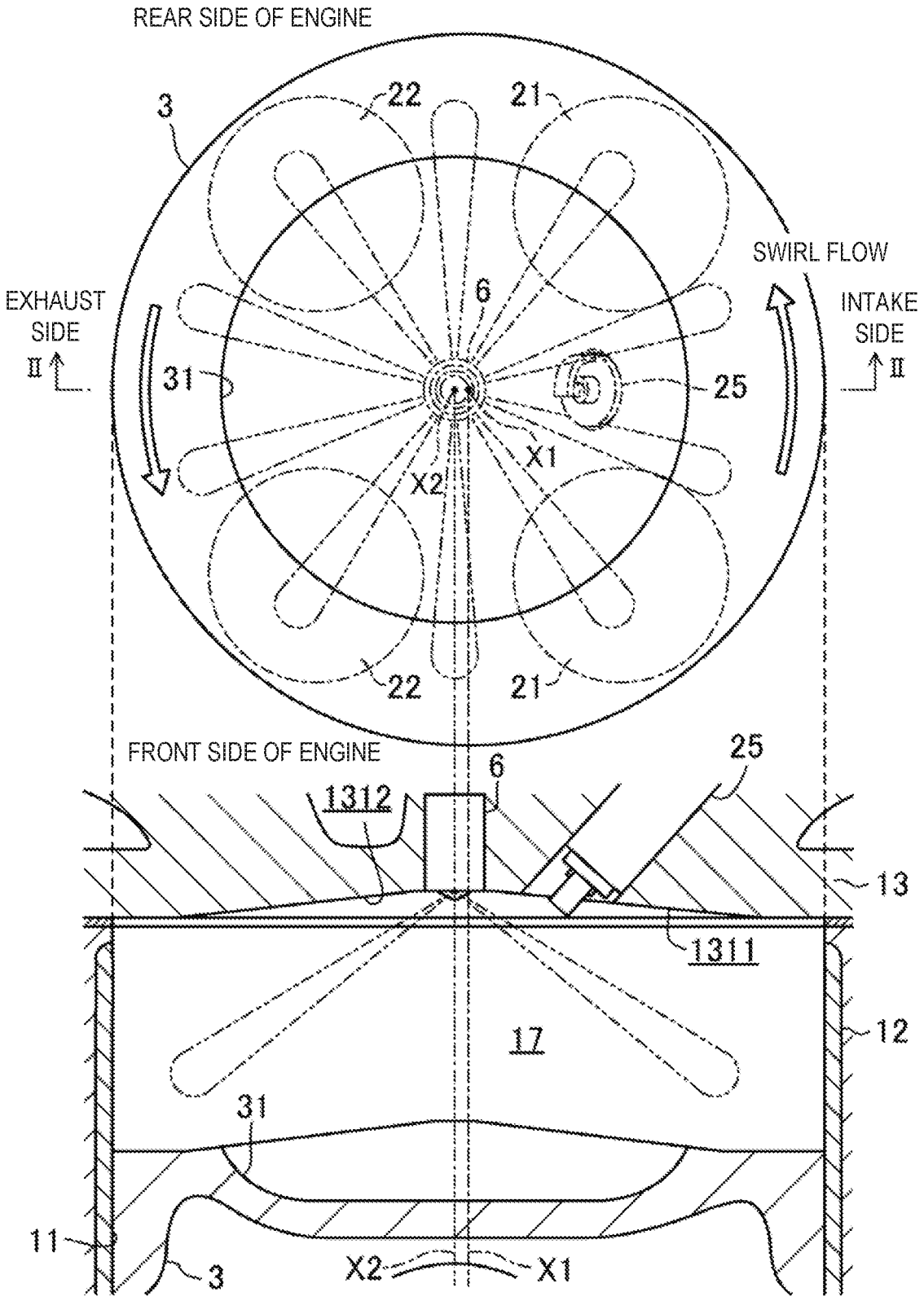
FIG. 2 is a view illustrating a configuration of a combustion chamber, where an upper figure corresponds to a plan view of the combustion chamber, and a lower figure is a cross-sectional view taken along a line II-II.
Figure 3:
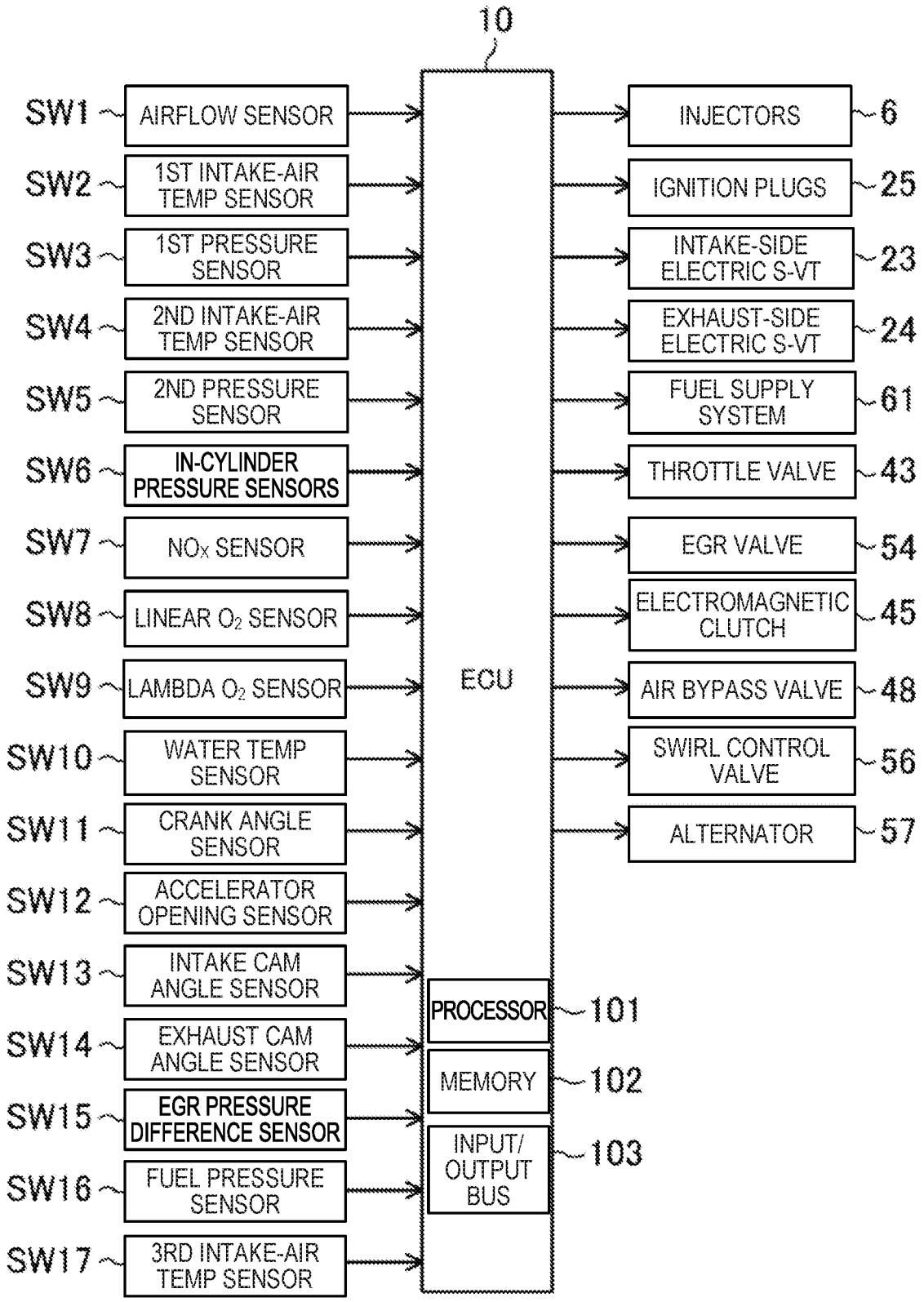
FIG. 3 is a block diagram illustrating a configuration of an engine control device.

FIG. 1 is a diagram illustrating a configuration of an engine system. FIG. 2 is a view illustrating a structure of a combustion chamber of the engine. Note that in FIG. 1, the intake side is on the left side and the exhaust side is on the right side of the drawing. In FIG. 2, the intake side is on the right side and the exhaust side is on the left side of the drawing. FIG. 3 is a block diagram illustrating a configuration of the control device of the engine.

An engine 1 is a four-stroke engine which operates by a combustion chamber 17 repeating an intake stroke, a compression stroke, an expansion stroke, and an exhaust stroke. The engine 1 is mounted on an automobile with four wheels. The automobile travels by operating the engine 1. Fuel of the engine 1 is gasoline in this example. The fuel may be a liquid fuel containing at least gasoline. The fuel may be gasoline containing, for example, bioethanol.

(Engine Configuration)

The engine 1 includes a cylinder block 12 and a cylinder head 13 placed thereon. A plurality of cylinders 11 are formed inside the cylinder block 12. In FIGS. 1 and 2, only one cylinder 11 is illustrated. The engine 1 is a multi-cylinder engine.

A piston 3 is slidably inserted in each cylinder 11. The pistons 3 are connected with a crankshaft 15 through respective connecting rods 14. Each piston 3 defines the combustion chamber 17, together with the cylinder 11 and the cylinder head 13. Note that the term "combustion chamber" may be used in a broad sense. That is, the term "combustion chamber" may refer to a space formed by the piston 3, the cylinder 11, and the cylinder head 13, regardless of the position of the piston 3.

As illustrated in the lower figure of FIG. 2, a lower surface of the cylinder head 13, i.e., a ceiling surface of the combustion chamber 17, is comprised of a slope 1311 and a slope 1312. The slope 1311 is a rising gradient from the intake side toward an injection axial center X2 of an injector 6 which will be described later. The slope 1312 is a rising gradient from the exhaust side toward the injection axial center X2. The ceiling surface of the combustion chamber 17 is a so-called "pent-roof" shape.

An upper surface of the piston 3 is bulged toward the ceiling surface of the combustion chamber 17. A cavity 31 is formed in the upper surface of the piston 3. The cavity 31 is a dent in the upper surface of the piston 3. The cavity 31 has a shallow pan shape in this example. The center of the cavity 31 is offset at the exhaust side with respect to a center axis X1 of the cylinder 11.

A geometric compression ratio of the engine 1 is set greater than or equal to 10:1 and less than or equal to 30:1. The engine 1 which will be described later performs SPCCI combustion that is a combination of spark ignition (SI) combustion and compression ignition (CI) combustion in a part of operating ranges. SPCCI combustion controls CI combustion using heat generation and a pressure buildup by SI combustion. The engine 1 is a compression-ignition type. In this engine 1, the temperature of the combustion chamber 17, when the piston 3 is at a compression top dead center (i.e., compression end temperature), does not need to be increased. In the engine 1, the geometric compression ratio can be set comparatively low. The low geometric compression ratio becomes advantageous in reduction of cooling loss and mechanical loss. For engines using regular gasoline (low octane fuel of which an octane number is about 91), the geometric compression ratio of the engine 1 is 14:1 to 17:1, and for those using high octane gasoline (high octane fuel of which the octane number is about 96), the geometric compression ratio is 15:1 to 18:1.

An intake port 18 is formed in the cylinder head 13 for each cylinder 11. Although is not illustrated in detail, each intake port 18 has a first intake port and a second intake port. The intake port 18 communicates with the corresponding combustion chamber 17. Although the detailed illustration of the intake port 18 is omitted, it is a so-called "tumble port". That is, the intake port 18 has such a shape that a tumble flow is formed in the combustion chamber 17.

An intake valve 21 is disposed in the intake port 18. The intake valve 21 opens and closes a channel between the combustion chamber 17 and the intake port 18. The intake valve 21 is opened and closed at given timings by a valve operating mechanism. The valve operating mechanism may be a variable valve operating mechanism which varies the valve timing and/or valve lift. In this example, as illustrated in FIG. 3, the variable valve operating mechanism has an intake-side electric S-VT (Sequential-Valve Timing) 23. The intake-side electric S-VT 23 continuously varies a rotation phase of an intake cam shaft within a given angle range. The valve open timing and the valve close timing of the intake valve 21 vary continuously. Note that the electric S-VT may be replaced with a hydraulic S-VT, as the intake valve operating mechanism.

An exhaust port 19 is also formed in the cylinder head 13 for each cylinder 11. Exhaust port 19 also has a first exhaust port and a second exhaust port. The exhaust port 19 communicates with the combustion chamber 17.

An exhaust valve 22 is disposed in the exhaust port 19. The exhaust valve 22 opens and closes a channel between the combustion chamber 17 and the exhaust port 19. The exhaust valve 22 is opened and closed at a given timing by a valve operating mechanism. The valve operating mechanism may be a variable valve operating mechanism which varies the valve timing and/or valve lift. In this example, as illustrated in FIG. 3, the variable valve operating mechanism has an exhaust-side electric S-VT 24. The exhaust-side electric S-VT 24 continuously varies a rotation phase of an exhaust cam shaft within a given angle range. The valve open timing and the valve close timing of the exhaust valve 22 change continuously. Note that the electric S-VT may be replaced with a hydraulic S-VT, as the exhaust valve operating mechanism.

The intake-side electric S-VT 23 and the exhaust-side electric S-VT 24 adjust length of an overlap period where both the intake valve 21 and the exhaust valve 22 open. If the length of the overlap period is made longer, the residual gas in the combustion chamber 17 can be purged. Moreover, by adjusting the length of the overlap period, internal EGR (Exhaust Gas Recirculation) gas can be introduced into the combustion chamber 17. The intake-side electric S-VT 23 and the exhaust-side electric S-VT 24 constitute an internal EGR system. Note that the internal EGR system may not be comprised of the S-VT.

The injector 6 is attached to the cylinder head 13 for each cylinder 11. Each injector 6 directly injects fuel into the combustion chamber 17. The injector 6 is disposed in a valley part of the pent roof where the slope 1311 and the slope 1312 meet. As illustrated in FIG. 2, the injection axial center X2 of the injector 6 is located at the exhaust side of the center axis X1 of the cylinder 11. The injection axial center X2 of the injector 6 is parallel to the center axis X1. The injection axial center X2 of the injector 6 and the center of the cavity 31 are in agreement with each other. The injector 6 faces the cavity 31. Note that the injection axial center X2 of the injector 6 may be in agreement with the center axis X1 of the cylinder 11. In such a configuration, the injection axial center X2 of the injector 6 and the center of the cavity 31 may be in agreement with each other.

Although detailed illustration is omitted, the injector 6 is comprised of a multi nozzle-port type fuel injection valve having a plurality of nozzle ports. As illustrated by two-dot chain lines in FIG. 2, the injector 6 injects fuel so that the fuel spreads radially from the center of the combustion chamber 17. The injector 6 has ten nozzle ports in this example, and the nozzle port is disposed so as to be equally spaced in the circumferential direction.

The injectors 6 are connected to a fuel supply system 61. The fuel supply system 61 includes a fuel tank 63 configured to store fuel, and a fuel supply passage 62 which connects the fuel tank 63 to the injector 6. In the fuel supply passage 62, a fuel pump 65 and a common rail 64 are provided. The fuel pump 65 sends fuel to the common rail 64. The fuel pump 65 is a plunger pump driven by the crankshaft 15 in this example. The common rail 64 stores fuel sent from the fuel pump 65 at a high fuel pressure. When the injector 6 is opened, the fuel stored in the common rail 64 is injected into the combustion chamber 17 from the nozzle ports of the injector 6. The fuel supply system 61 can supply fuel to the injectors 6 at a high pressure of greater than or equal to 30 MPa. The pressure of fuel supplied to the injector 6 may be changed according to the operating state of the engine 1. Note that the configuration of the fuel supply system 61 is not limited to the configuration described above.

An ignition plug 25 is attached to the cylinder head 13 for each cylinder 11. The ignition plug 25 forcibly ignites a mixture gas inside the combustion chamber 17. The ignition plug 25 is disposed at the intake side of the center axis X1 of the cylinder 11 in this example. The ignition plug 25 is located between the two intake ports 18 of each cylinder. The ignition plug 25 is attached to the cylinder head 13 so as to incline downwardly toward the center of the combustion chamber 17. As illustrated in FIG. 2, the electrodes of the ignition plug 25 face to the inside of the combustion chamber 17 and are located near the ceiling surface of the combustion chamber 17. Note that the ignition plug 25 may be disposed at the exhaust side of the center axis X1 of the cylinder 11. Moreover, the ignition plug 25 may be disposed on the center axis X1 of the cylinder 11.

An intake passage 40 is connected to one side surface of the engine 1. The intake passage 40 communicates with the intake port 18 of each cylinder 11. Gas introduced into the combustion chamber 17 flows through the intake passage 40. An air cleaner 41 is disposed in an upstream end part of the intake passage 40. The air cleaner 41 filters fresh air. A surge tank 42 is disposed near the downstream end of the intake passage 40. Part of the intake passage 40 downstream of the surge tank 42 constitutes independent passages branched from the intake passage 40 for each cylinder 11. The downstream end of each independent passage is connected to the intake port 18 of each cylinder 11.

A throttle valve 43 is disposed between the air cleaner 41 and the surge tank 42 in the intake passage 40. The throttle valve 43 adjusts an introducing amount of the fresh air into the combustion chamber 17 by adjusting an opening of the throttle valve.

A supercharger 44 is also disposed in the intake passage 40, downstream of the throttle valve 43. The supercharger 44 boosts gas to be introduced into the combustion chamber 17. In this example, the supercharger 44 is a mechanical supercharger driven by the engine 1. The mechanical supercharger 44 may be a root, Lysholm, vane, or a centrifugal type.

An electromagnetic clutch 45 is provided between the supercharger 44 and the engine 1. The electromagnetic clutch 45 transmits a driving force from the engine 1 to the supercharger 44 or disengages the transmission of the driving force between the supercharger 44 and the engine 1. As will be described later, an ECU 10 switches the connection and disengagement of the electromagnetic clutch 45 to switch the supercharger 44 between ON and OFF.

An intercooler 46 is disposed downstream of the supercharger 44 in the intake passage 40. The intercooler 46 cools gas compressed by the supercharger 44. The intercooler 46 may be of a water-cooling type or an oil cooling type, for example.

A bypass passage 47 is connected to the intake passage 40. The bypass passage 47 connects an upstream part of the supercharger 44 to a downstream part of the intercooler 46 in the intake passage 40 so as to bypass the supercharger 44 and the intercooler 46. An air bypass valve 48 is disposed in the bypass passage 47. The air bypass valve 48 adjusts a flow rate of gas flowing through the bypass passage 47.

The ECU 10 fully opens the air bypass valve 48 when the supercharger 44 is turned OFF (i.e., when the electromagnetic clutch 45 is disengaged). The gas flowing through the intake passage 40 bypasses the supercharger 44 and is introduced into the combustion chamber 17 of the engine 1. The engine 1 operates in a non-supercharged state, i.e., a natural aspiration state.

When the supercharger 44 is turned ON, the engine 1 operates in a supercharged state. The ECU 10 adjusts an opening of the air bypass valve 48 when the supercharger 44 is turned ON (i.e., when the electromagnetic clutch 45 is connected). A portion of the gas which passed through the supercharger 44 flows back upstream of the supercharger 44 through the bypass passage 47. When the ECU 10 adjusts the opening of the air bypass valve 48, a supercharging pressure of gas introduced into the combustion chamber 17 changes. Note that the term "supercharging" as used herein refers to a situation where the pressure inside the surge tank 42 exceeds an atmospheric pressure, and "non-supercharging" refers to a situation where the pressure inside the surge tank 42 becomes less than the atmospheric pressure.

In this example, a supercharging system 49 is comprised of the supercharger 44, the bypass passage 47, and the air bypass valve 48.

The engine 1 has a swirl generating part which generates a swirl flow inside the combustion chamber 17. The swirl flow is oriented as indicated by the white arrows in FIG. 2. The swirl generating part has a swirl control valve 56 attached to the intake passage 40. Although not illustrated in detail, among a primary passage coupled to one of the two intake ports and a secondary passage coupled to the other intake port, the swirl control valve 56 is disposed in the secondary passage. The swirl control valve 56 is an opening control valve which is capable of choking a cross section of the secondary passage. When the opening of the swirl control valve 56 is small, since an intake flow rate of air entering the combustion chamber 17 from the one of the intake ports 18 is relatively large, and an intake flow rate of air entering the combustion chamber 17 from the other intake port is relatively small, the swirl flow inside the combustion chamber 17 becomes stronger. On the other hand, when the opening of the swirl control valve 56 is large, since the intake flow rates of air entering the combustion chamber 17 from the two intake ports 18 become substantially equal, the swirl flow inside the combustion chamber 17 becomes weaker. When the swirl control valve 56 is fully opened, the swirl flow will not occur.

An exhaust passage 50 is connected to the other side surface of the engine 1. The exhaust passage 50 communicates with the exhaust port 19 of each cylinder 11. The exhaust passage 50 is a passage through which exhaust gas discharged from the combustion chambers 17 flows. Although the detailed illustration is omitted, an upstream part of the exhaust passage 50 constitutes independent passages branched from the exhaust passage 50 for each cylinder 11. The upper end of the independent passage is connected to the exhaust port 19 of each cylinder 11.

An exhaust gas purification system having a plurality of catalytic converters is disposed in the exhaust passage 50. Although illustration is omitted, an upstream catalytic converter is disposed inside an engine bay. The upstream catalytic converter has a three-way catalyst 511 and a GPF (Gasoline Particulate Filter) 512. The downstream catalytic converter is disposed outside the engine room. The downstream catalytic converter has a three-way catalyst 513. Note that the exhaust gas purification system is not limited to the illustrated configuration. For example, the GPF 512 may be omitted. Moreover, the catalytic converter is not limited to those having the three-way catalyst. Further, the order of the three-way catalyst and the GPF may suitably be changed.

Between the intake passage 40 and the exhaust passage 50, an EGR passage 52 which constitutes an external EGR system is connected. The EGR passage 52 is a passage for recirculating a portion of the exhaust gas to the intake passage 40. The upstream end of the EGR passage 52 is connected between the upstream catalytic converter and the downstream catalytic converter in the exhaust passage 50. The downstream end of the EGR passage 52 is connected to an upstream part of the supercharger 44 in the intake passage 40. EGR gas flowing through the EGR passage 52 flows into the upstream part of the supercharger 44 in the intake passage 40, without passing through the air bypass valve 48 of the bypass passage 47.

An EGR cooler 53 of water-cooling type is disposed in the EGR passage 52. The EGR cooler 53 cools the exhaust gas. An EGR valve 54 is also disposed in the EGR passage 52. The EGR valve 54 adjusts a flow rate of the exhaust gas flowing through the EGR passage 52. By adjusting the opening of the EGR valve 54, an amount of the cooled exhaust gas, i.e., a recirculating amount of external EGR gas can be adjusted.

In this example, an EGR system 55 is comprised of the external EGR system and the internal EGR system. The external EGR system can supply the lower-temperature exhaust gas to the combustion chamber 17 than the internal EGR system.

In FIGS. 1 and 3, an alternator 57 is connected with the crankshaft 15. The alternator 57 is driven by the engine 1.

The control device of the internal combustion engine includes the ECU (Engine Control Unit) 10 for operating the engine 1. The ECU 10 is a controller based on a known microcomputer, and as illustrated in FIG. 3, includes a processor (e.g., a central processing unit (CPU)) 101 which executes software programs, memory 102 which is comprised of, for example, RAM (Random Access Memory) and/or ROM (Read Only Memory) and stores the software programs and data, and an input/output bus 103 through which an electrical signal is inputted and outputted. The ECU 10 is one example of a "controller".

As illustrated in FIGS. 1 and 3, various kinds of sensors SW1-SW17 are connected to the ECU 10. The sensors SW1-SW17 output signals to the ECU 10. The sensors include the following sensors:

Airflow sensor SW1: Disposed downstream of the air cleaner 41 in the intake passage 40, and measures a flow rate of fresh air flowing through the intake passage 40;

First intake-air temperature sensor SW2: Disposed downstream of the air cleaner 41 in the intake passage 40, and measures the temperature of fresh air flowing through the intake passage 40;

First pressure sensor SW3: Disposed downstream of the connected position of the EGR passage 52 in the intake passage 40 and upstream of the supercharger 44, and measures the pressure of gas flowing into the supercharger 44;

Second intake-air temperature sensor SW4: Disposed downstream of the supercharger 44 in the intake passage 40 and upstream of the connected position of the bypass passage 47, and measures the temperature of gas flowed out of the supercharger 44;

Second pressure sensor SW5: Attached to the surge tank 42, and measures the pressure of gas downstream of the supercharger 44;

In-cylinder pressure sensors SW6: Attached to the cylinder head 13 corresponding to each cylinder 11, and measures the pressure inside each combustion chamber 17;

$NO_x$ sensor SW7: Disposed downstream of the three-way catalyst 513 in the exhaust passage 50, and measures a $NO_x$ concentration of the exhaust gas after passing through the three-way catalyst 513;

Linear $O_2$ sensor SW8: Disposed upstream of the three-way catalyst 511 in the upstream catalyst, and measures the oxygen concentration of the exhaust gas;

Lambda $O_2$ sensor SW9: Disposed downstream of the three-way catalyst 511 in the upstream catalytic converter, and measures the oxygen concentration of the exhaust gas;

Water temperature sensor SW10: Attached to the engine 1 and measures the temperature of coolant;

Crank angle sensor SW11: Attached to the engine 1 and measures the rotation angle of the crankshaft 15;

Accelerator opening sensor SW12: Attached to an accelerator pedal mechanism and measures the accelerator opening corresponding to an operating amount of the accelerator pedal;

Intake cam angle sensor SW13: Attached to the engine 1 and measures the rotation angle of the intake cam shaft;

Exhaust cam angle sensor SW14: Attached to the engine 1 and measures the rotation angle of the exhaust cam shaft;

EGR pressure difference sensor SW15: Disposed in the EGR passage 52 and measures a pressure difference between the upstream and the downstream of the EGR valve 54;

Fuel pressure sensor SW16: Attached to the common rail 64 of the fuel supply system 61, and measures the pressure of fuel supplied to the injector 6; and Third intake-air temperature sensor SW17: Attached to the surge tank 42, and measures the temperature of gas inside the surge tank 42, i.e., the temperature of intake air introduced into the combustion chamber 17.

The ECU 10 determines the operating state of the engine 1 based on the signals of the sensors SW1-SW17, and calculates a control amount of each device according to the control logic defined beforehand. The control logic is stored in the memory 102. The control logic includes calculating a target amount and/or the control amount by using an operation map stored in the memory 102.

The ECU 10 outputs electrical signals according to the calculated control amounts to the injectors 6, the ignition plugs 25, the intake-side electric S-VT 23, the exhaust-side electric S-VT 24, the fuel supply system 61, the throttle valve 43, the EGR valve 54, the electromagnetic clutch 45 of the supercharger 44, the air bypass valve 48, the swirl control valve 56, and the alternator 57.

For example, the ECU 10 sets a target torque of the engine 1 based on the signal of the accelerator opening sensor SW12 and the operation map, and determines a target supercharging pressure. The ECU 10 then performs a feedback control for adjusting the opening of the air bypass valve 48 based on the target supercharging pressure and the pressure difference before and after the supercharger 44 obtained from the signals of the first pressure sensor SW3 and the second pressure sensor SW5 so that the supercharging pressure becomes the target supercharging pressure.

Moreover, the ECU 10 sets a target EGR rate based on the operating state of the engine 1 and the operation map. The EGR rate is a ratio of the EGR gas to the entire gas inside the combustion chamber 17. The ECU 10 then determines a target EGR gas amount based on the target EGR rate and an inhaled air amount based on the signal of the accelerator opening sensor SW12, and performs a feedback control for adjusting the opening of the EGR valve 54 based on the pressure difference before and after the EGR valve 54 obtained from the signal of the EGR pressure difference sensor SW15 so that the external EGR gas amount introduced into the combustion chamber 17 becomes the target EGR gas amount.

Further, the ECU 10 performs an air-fuel ratio feedback control when a given control condition is satisfied. For example, the ECU 10 adjusts the fuel injection amount of the injector 6 based on the oxygen concentration of the exhaust gas which is measured by the linear $O_2$ sensor SW8 and the lambda $O_2$ sensor SW9 so that the air-fuel ratio of the mixture gas becomes a desired value.

Note that other controls of the engine 1 executed by the ECU 10 will be described later.

(Concept of SPCCI Combustion)

The engine 1 performs combustion by compressed self-ignition under a given operating state, mainly to improve fuel consumption and emission performance. The combustion by self-ignition varies largely in the timing of the self-ignition, if the temperature inside the combustion chamber 17 before a compression starts is nonuniform. Thus, the engine 1 performs SPCCI combustion which is a combination of SI combustion and CI combustion.

SPCCI combustion is combustion in which the ignition plug 25 forcibly ignites the mixture gas inside the combustion chamber 17 so that the mixture gas carries out SI combustion by flame propagation, and the temperature inside the combustion chamber 17 increases by the heat generation of SI combustion and the pressure inside the combustion chamber 17 increases by the flame propagation so that unburnt mixture gas carries out CI combustion by self-ignition.

By adjusting the heat amount of SI combustion, the variation in the temperature inside the combustion chamber 17 before a compression starts can be absorbed. By the ECU 10 adjusting the ignition timing, the mixture gas can be self-ignited at a target timing.

Figure 4:
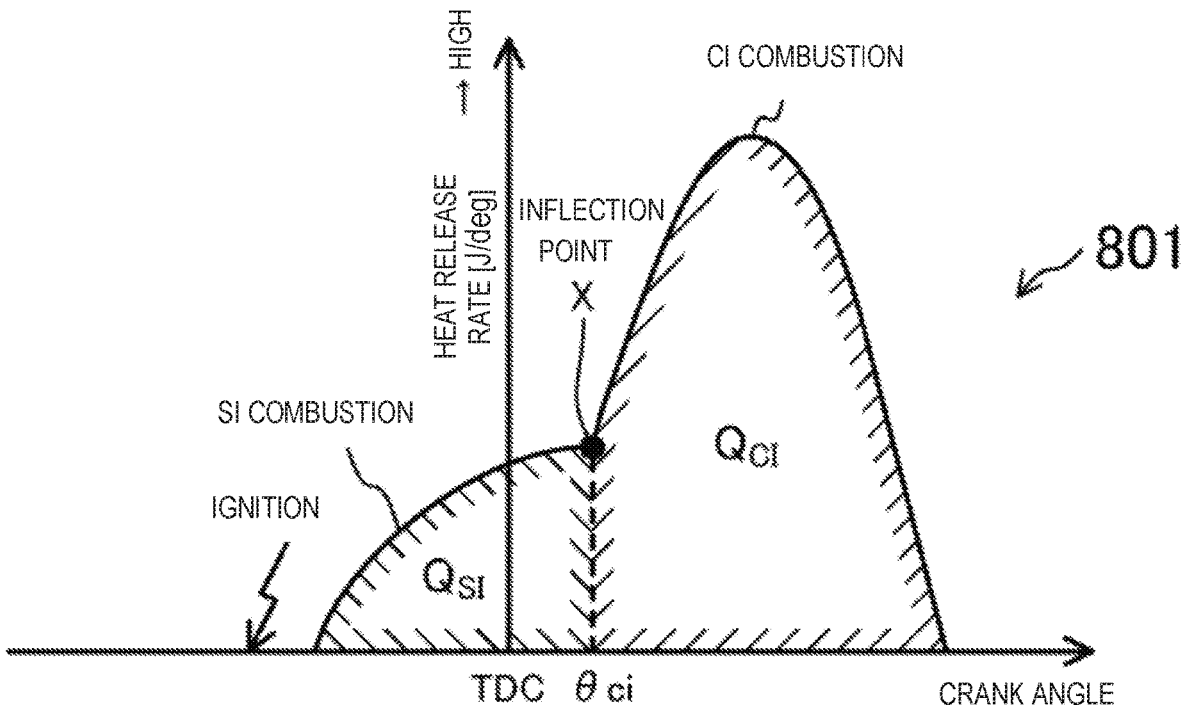
FIG. 4 is a graph illustrating a waveform of SPCCI combustion.

In SPCCI combustion, the heat release of SI combustion is slower than the heat release in CI combustion. FIG. 4 illustrates a waveform 801 of the heat release rate of SPCCI combustion. The waveform 801 has a shallower rising slope in SI combustion than in CI combustion. In addition, SI combustion is slower in the pressure fluctuation (dp/dθ) inside the combustion chamber 17 than CI combustion.

When the unburnt mixture gas self-ignites after SI combustion is started, the waveform slope of the heat release rate may become steeper. The waveform of the heat release rate may have an inflection point X at a timing of starting CI combustion (θci).

After the start in CI combustion, SI combustion and CI combustion are performed in parallel. Since CI combustion has a larger heat release than SI combustion, the heat release rate becomes relatively high. However, since CI combustion is performed after a compression top dead center, the waveform slope of the heat release rate does not become too steep. The pressure fluctuation in CI combustion (dp/dθ) also becomes comparatively slow.

The pressure fluctuation (dp/dθ) can be used as an index representing combustion noise. As described above, since SPCCI combustion can reduce the pressure fluctuation (dp/dθ), it is possible to avoid too large combustion noise. The combustion noise of the engine 1 can be kept below the tolerable level.

SPCCI combustion is completed when CI combustion is finished. CI combustion is shorter in the combustion period than SI combustion. The end timing of SPCCI combustion becomes earlier than SI combustion.

The heat release rate waveform of SPCCI combustion is formed so that a first heat release rate part $Q_{SI}$ formed by SI combustion and a second heat release rate part $Q_{CI}$ formed by CI combustion continue in this order.

(Engine Operating Range)

Figure 5:
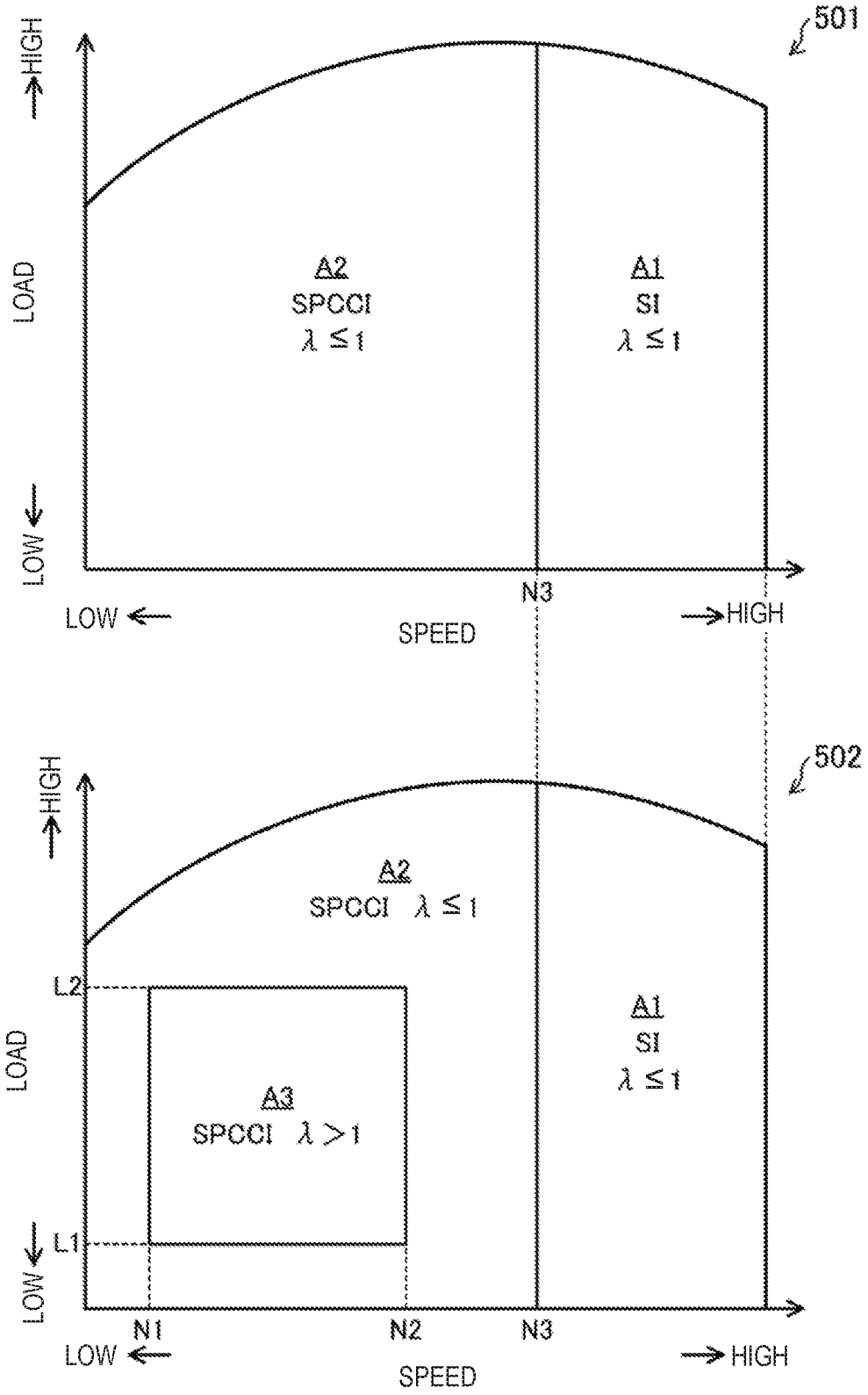
FIG. 5 is a view illustrating operation maps of the engine.

FIG. 5 illustrates the operation maps according to the control of the engine 1. The operation maps are stored in the memory 102 of the ECU 10, among which a first map 501 is a map when the engine 1 is half-warm, a second map 502 is a map when the engine 1 is warm. The ECU 10 selects one of the maps 501 and 502 for the control of the engine 1 according to a wall temperature of the combustion chamber 17 and intake air temperature. The ECU 10 controls the engine 1 by using the selected operation map.

The maps 501 and 502 are defined by the load and the engine speed of the engine 1. The operation map 501 is divided into two areas according to the engine speed. Specifically, the operation map 501 is divided into a high speed area A1 where the speed is higher than an engine speed N3, and an area A2 extending in a low and middle engine speed area (an example of a "first area"). The operation map 502 is divided into three areas. Specifically, the operation map 502 is divided into the high speed area A1 and the low and middle speed area A2 which are described above, and an area A3 located within the area A2 and having a given speed range from N1 to N2 and a given load range from L1 to L2 (an example of a "second area").

Here, the low speed area, the middle speed area, and the high speed area may be defined by substantially equally dividing the entire operating range of the engine 1 into three areas in the engine speed direction.

The operation maps 501 and 502 of FIG. 5 illustrate states of the mixture gas and combustion states in the respective areas. The engine 1 performs the SI combustion in the area A1. The engine 1 performs the SPCCI combustion in the areas A2 and A3. Hereinafter, the operation of the engine 1 in the respective areas of the operations maps 501 and 502 of FIG. 5 is described in detail.

(Operation of Engine in Area A3)

The engine 1 performs SPCCI combustion when the engine 1 operates in the area A3.

In order to improve fuel efficiency of the engine 1, the EGR system 55 introduces the EGR gas into the combustion chamber 17. For example, the intake-side electric S-VT 23 and the exhaust-side electric S-VT 24 are provided with a positive overlap period where both the intake valve 21 and the exhaust valve 22 are opened near an exhaust top dead center.

An air-fuel ratio (A/F) of the mixture gas is leaner than the stoichiometric air-fuel ratio throughout the combustion chamber 17 (i.e., excess air ratio $\lambda>1$). For example, the A/F of the mixture gas is greater than or equal to 25:1 and less than or equal to 31:1 throughout the combustion chamber 17. Thus, the generation of raw $NO_x$ can be reduced to improve the emission performance. The throttle valve 43 is fully opened.

After the injector 6 finishes the fuel injection, the ignition plug 25 ignites the mixture gas in the combustion chamber 17. The engine 1 performs a lean combustion operation in the area A3.

(Operation of Engine in Area A2)

When the engine 1 operates in the area A2, the engine 1 performs SPCCI combustion.

The EGR system 55 introduces the EGR gas into the combustion chamber 17. For example, the intake-side electric S-VT 23 and the exhaust-side electric S-VT 24 are provided with a positive overlap period where both the intake valve 21 and the exhaust valve 22 are opened near an exhaust top dead center. Internal EGR gas is introduced into the combustion chamber 17. Moreover, the EGR system 55 introduces the exhaust gas cooled by the EGR cooler 53 into the combustion chamber 17 through the EGR passage 52 in at least part of the area A2. That is, the external EGR gas with a lower temperature than the internal EGR gas is introduced into the combustion chamber 17. The external EGR gas adjusts the temperature inside the combustion chamber 17 to a suitable temperature. The EGR system 55 reduces the amount of the EGR gas as the engine load increases. The EGR system 55 may not recirculate the EGR gas containing the internal EGR gas and the external EGR gas during the full load.

The air-fuel ratio (A/F) of the mixture gas is the stoichiometric air-fuel ratio (A/F≈14.7:1) throughout the combustion chamber 17. Since the three-way catalysts 511 and 513 purify the exhaust gas discharged from the combustion chamber 17, emission performance of the engine 1 is improved. The A/F of the mixture gas may be set within a purification window of the three-way catalyst. The excess air ratio $\lambda$ of the mixture gas may be 1.0±0.2. Note that when the engine 1 operates at the full load (i.e., the maximum load), the A/F of the mixture gas may be set at the stoichiometric air-fuel ratio or richer than the stoichiometric air-fuel ratio (i.e., the excess air ratio $\lambda$ of the mixture gas is $\lambda\leq1$) throughout the combustion chamber 17. The throttle valve 43 is adjusted to be fully opened or an intermediate opening.

Since the EGR gas is introduced into the combustion chamber 17, a gas-fuel ratio (G/F) which is a weight ratio of the entire gas to the fuel in the combustion chamber 17 becomes leaner than the stoichiometric air-fuel ratio. The G/F of the mixture gas may be greater than or equal to 18:1. Thus, a generation of a so-called "knock" is prevented. The G/F may be set greater than or equal to 18:1 and less than or equal to 30:1. Alternatively, the G/F may be set greater than or equal to 18:1 and less than or equal to 50:1.

The ignition plug 25 ignites the mixture gas at a given timing near a compression top dead center after the injector 6 performs the fuel injection. The engine 1 performs a stoichiometric combustion operation in the area A2.

(Operation of Engine in Area A1)

As the engine speed increases, a time required for changing the crank angle by 1° becomes shorter. As the engine speed increases, it becomes difficult to perform SPCCI combustion.

Thus, while the engine 1 is operating in the area A1, the engine 1 performs not SPCCI combustion but SI combustion.

The EGR system 55 introduces EGR gas into the combustion chamber 17. The EGR system 55 reduces an amount of EGR gas as the load increases. The EGR system 55 may set the EGR gas amount to zero when the engine is operating with full load.

Fundamentally, an air-fuel ratio (A/F) of mixture gas is a stoichiometric air-fuel ratio (A/F≈14.7:1) entirely in the combustion chamber 17. An excess air ratio $\lambda$ of mixture gas may be set to 1.0±0.2. Note that while the engine 1 is operating with near the full load, the excess air ratio $\lambda$ of mixture gas may be less than one. The throttle valve 43 is adjusted to be fully opened or an intermediate opening.

The ignition plug 25 ignites the mixture gas at a suitable timing near the compression top dead center after the injector 6 finishes the fuel injection.

(Layer Structure of Operation Map)

Figure 6:
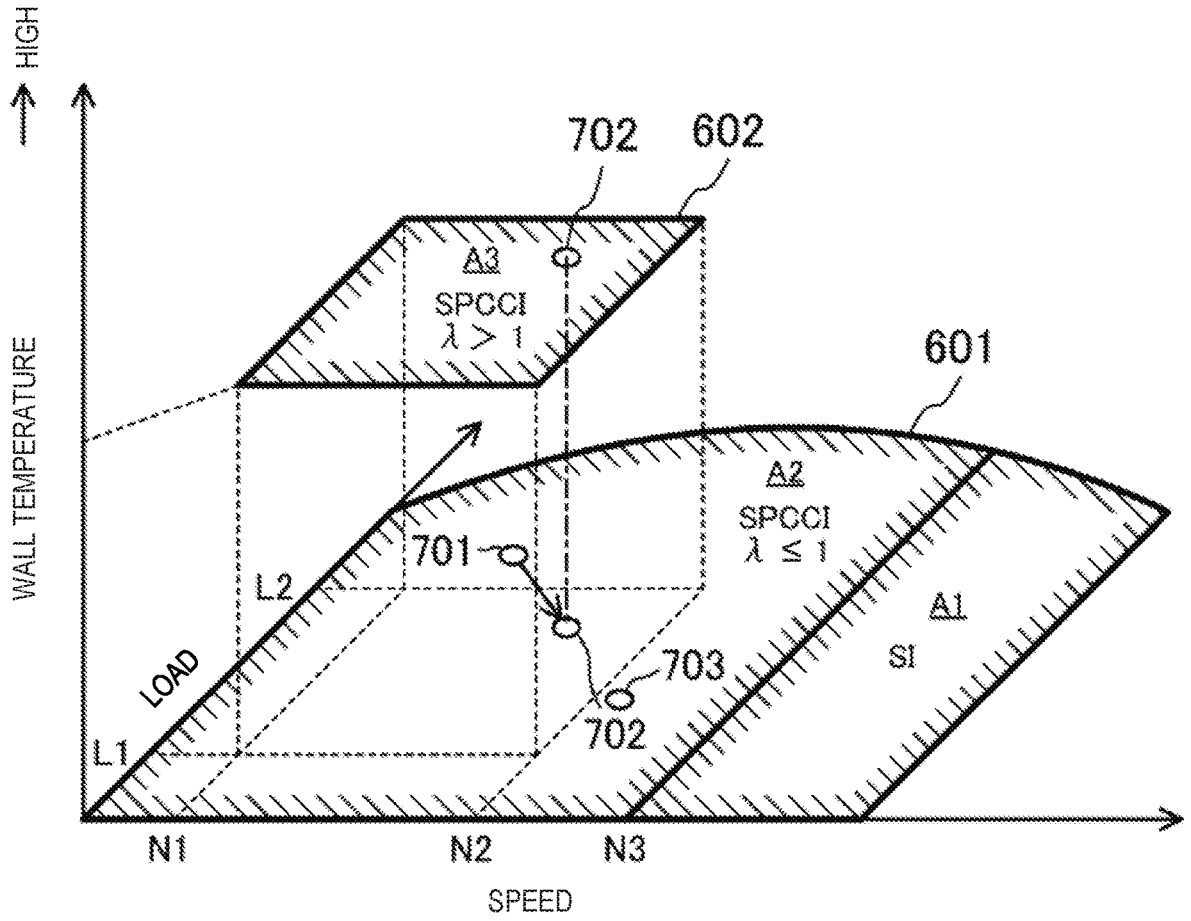
FIG. 6 is a view illustrating a layer structure of the operation maps of the engine.

The maps 501 and 502 are comprised of a combination of a first layer 601 and a second layer 602 illustrated in FIG. 6. The first layer 601 corresponds to the operation map 501 described above. The first Layer 601 includes the areas A1 and A2.

The second layer 602 is a layer superimposed on the first layer 601. The second layer 602 corresponds to a part of the operating range of the engine 1. Specifically, the second layer 602 corresponds to the area A3 of the operation map 502 described above.

The second layer 602 is selected according to the wall temperature of the combustion chamber 17 and the temperature of intake air. When the wall temperature of the combustion chamber 17 is low or the intake air temperature is low, the operation map 501 is formed solely by the first layer 601 without selecting the second layer 602.

When the wall temperature of the combustion chamber 17 is high and the intake air temperature is high, the second layer 602 is selected, and the operation map 502 is formed by overlapping the first and second layers 601 and 602. In the area A3 of the operation map 502, the second layer 602 which is located at the top therein is enabled, and in the area A1 and the area A2 other than the area A3, the first layer 601 is enabled.

When the wall temperature of the combustion chamber 17 is high and the intake air temperature is high, SPCCI combustion of the mixture gas leaner than the stoichiometric air-fuel ratio can be stably carried out. By selecting the second layer 602, SPCCI combustion of the lean mixture gas is carried out in part of the operating range of the engine 1. Thus, fuel efficiency of the engine 1 improves.

When the wall temperature of the combustion chamber 17 is low or the intake air temperature is low, although SPCCI combustion of the mixture gas leaner than the stoichiometric air-fuel ratio cannot be stably carried out, SPCCI combustion of the mixture gas at or substantially at the stoichiometric air-fuel ratio can be stably carried out. By carrying out the SPCCI combustion instead of the SI combustion in part of the operating range of the engine 1, fuel efficiency of the engine 1 improves.

(Switching of Operation Mode of Engine)

The ECU 10 operates the engine 1 with one of SPCCI combustion and SI combustion based on an operation point and the operation maps 501 and 502 defined by the engine load and the engine speed. In the SPCCI combustion, the ECU 10 operates the engine 1 in one of the stoichiometric combustion mode and the lean combustion mode. When the operation point of the engine 1 changes, the engine 1 switches its combustion mode from the stoichiometric combustion mode to the lean combustion mode or vice versa.

Figure 7:
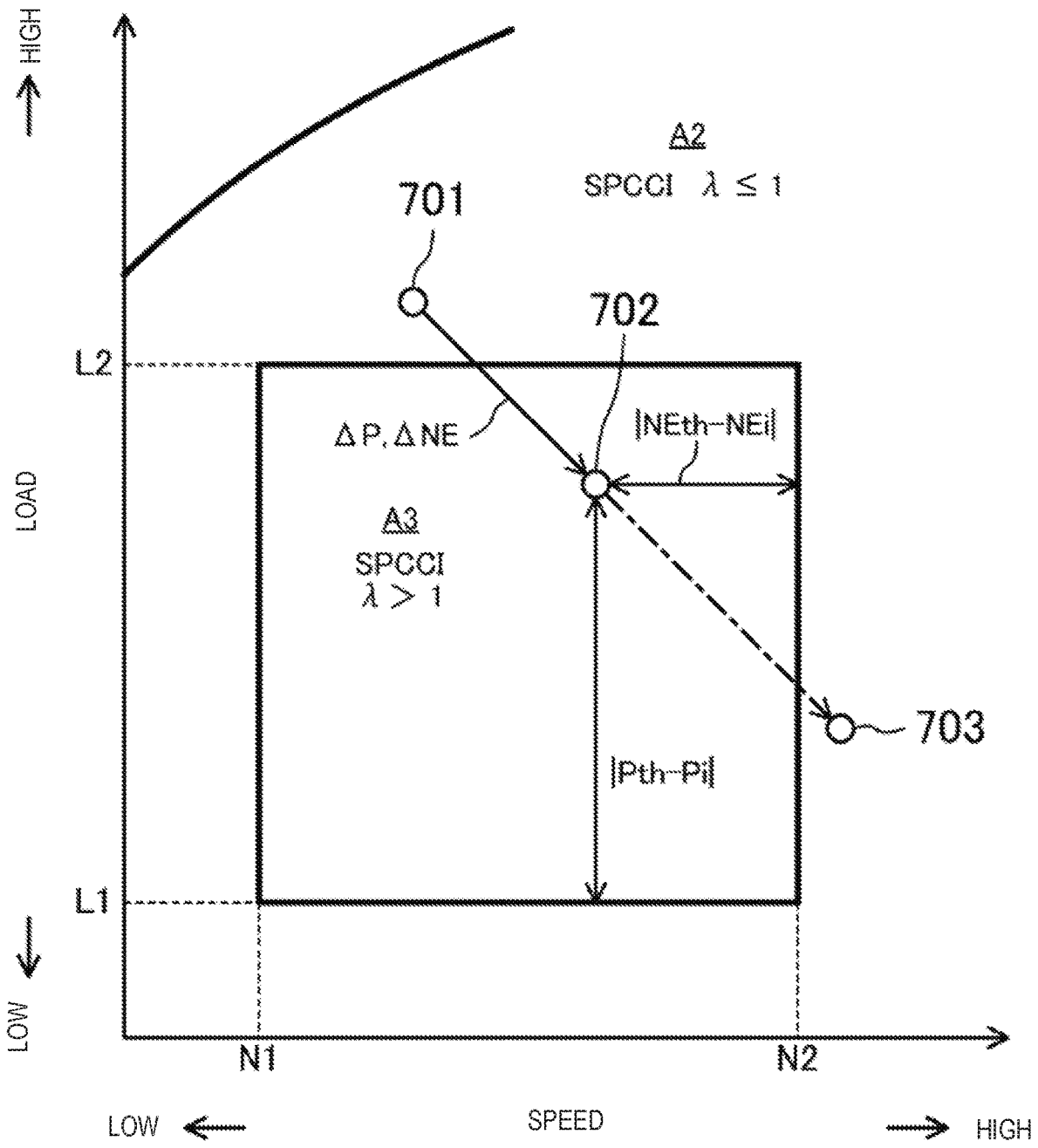
FIG. 7 is a chart illustrating a change of an operation point of the engine.

FIG. 7 illustrates one example in which the operation point of the engine 1 changes in the operation map of the engine 1. The example of FIG. 7 indicates a case where, according to the accelerator operation by a vehicle driver, the engine load decreases and the engine speed increases from an operation point 701 at which the engine 1 operates in the stoichiometric combustion mode in the area A2, to an operation point 702 in the area A3. The operation point of the engine 1 crosses over a boundary between the areas A2 and A3 (here, a boundary of the load L2), and shifts from the area A2 to the area A3.

When the operation point of the engine 1 shifts from the area A2 to the area A3, the ECU 10 operates the engine 1 in the lean combustion mode so as to correspond to the area A3. However, in order to change the air-fuel ratio of the mixture gas from the stoichiometric air-fuel ratio to lean, a state function in the combustion chamber 17 needs to be greatly changed. Further, as indicated by the one-dotted chain line in FIG. 7, the operation point of the engine 1 may pass through the area A3 and immediately shift to an operation point 703 in the area A2. Furthermore, although not illustrated, when the driver repeats the on/off of the accelerator operation, the operation point of the engine 1 may change so that, for example, it may repeatedly cross over the boundary of the load L2.

In addition, since the combustion state varies between the lean combustion mode and the stoichiometric combustion mode, the combustion sound is different therebetween. If the combustion sound changes sharply by switching the combustion state, a person in the vehicle may feel uncomfortable. Therefore, for switching the combustion state, a period in which a torque generation is reduced by a given amount against a target torque set based on the accelerator depression amount, etc., by retarding the ignition timing is provided.

For this reason, if the operation point of the engine 1 frequently shifts between the area A3 in which the lean combustion mode is performed and the area A2 in which the stoichiometric combustion mode is performed, the in-cylinder state function may not be adjusted in time, the combustion may become unstable, and the torque reduction operation for switching the combustion state may frequently be performed, resulting in degradation in fuel efficiency.

Therefore, when the operation point of the engine 1 shifts from the area A2 to the area A3 by crossing their boundary, the engine 1 predicts a length of a staying time in the area A3, and switches the combustion mode or prohibits the switch according to the length of the staying time. Thereby, unstable combustion caused by frequently switching the combustion mode is prevented and degradation in fuel efficiency is prevented.

Figure 8:
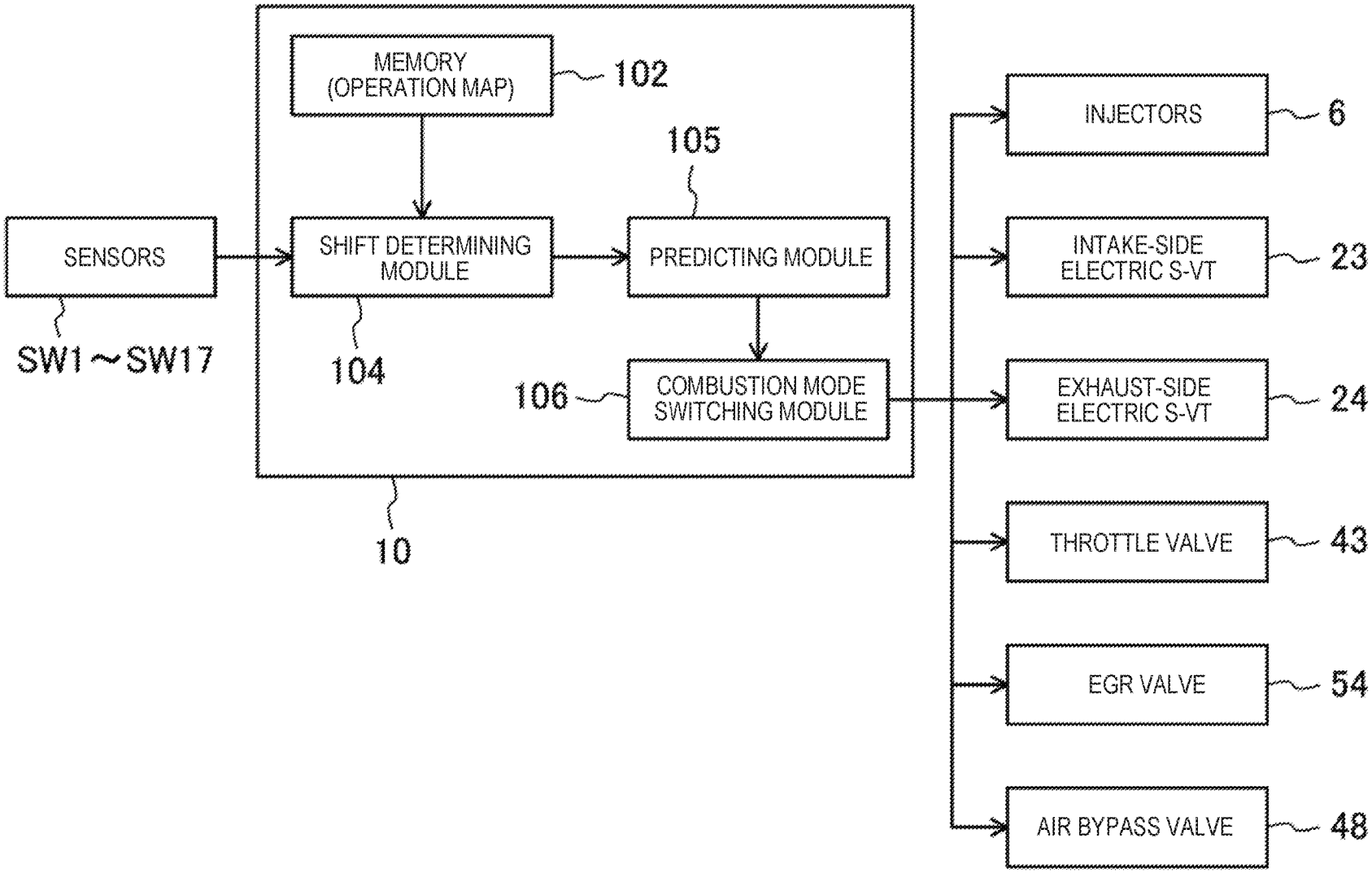
FIG. 8 is a block diagram illustrating functional blocks of an ECU which executes a control regarding switching of a combustion mode of the engine.

FIG. 8 illustrates software modules of the ECU 10 stored in the memory 102 which are executed by the processor 101 to perform their respective functions related to control of switching of the combustion mode. The ECU 10 includes a shift determining module 104, a predicting module 105, and a combustion mode switching module 106.

The shift determining module 104 determines the operation point of the engine 1 based on the signals of the sensors SW1 to SW17 described above. Based on the operation point and the operation map 502 stored in the memory 102, the shift determining module 104 determines whether the operation point of the engine 1 shifts from the area A2 to the area A3 or from the area A3 to the area A2.

When the shift determining module 104 determines that the operation point shifts from the area A2 to the area A3, the predicting module 105 predicts the length of time for which the operation point stays in the area A3. Specifically, the predicting module 105 predicts the staying time based on a distance from the operation point in the area A3 to the boundary between the area A2 and the area A3, and a speed of the operation point shifting to the area A3 over the boundary between the area A2 and the area A3.

For example, as illustrated in FIG. 7, a case where the operation point shifts from the operation point 701 to the operation point 702 is considered. Assuming that the load and pressure at the operation point 701 are Pi−1 and NEi−1, respectively, and the load and pressure at the operation point 702 are Pi and NEi, respectively, the distance from the operation point 702 in the area A3 to the boundary between the area A2 and the area A3 is expressed as |Pth−Pi| for the load direction and |NEth−NEi| for the engine speed direction. Here, the boundary between the area A2 and the area A3 is a boundary located in an extension of the moving direction of the operation point. In the example of FIG. 7, the boundary in the load direction corresponds to the load L1 (that is, Pth=L1), and the boundary in the engine speed direction corresponds to the engine speed N2 (that is, NEth=N2).

Further, in the example of FIG. 7, a speed ΔP in the load direction at the operation point is expressed as $\Delta P=|Pi-Pi-1|/\Delta t$ using the time Δt required to shift from the operation point 701 to the operation point 702. A speed ΔNE in the engine speed direction is expressed as $\Delta NE=|NEi-NEi-1|/\Delta t$.

Here, the staying time in the load direction is expressed as $|Pth-Pi|/\Delta P$, and the staying time in the engine speed direction is expressed as $|NEth-NEi|/\Delta NE$.

The combustion mode switching module 106 determines that the operation point stays in the area A3 for a long time when the staying time is longer than a preset reference time based on the staying time $|Pth-Pi|/\Delta P$ and $|NEth-NEi|/\Delta NE$ predicted by the predicting module 105. The combustion mode switching module 106 switches the combustion mode to the lean combustion mode corresponding to the shifted area A3.

On the other hand, when the staying time is shorter than the reference time, the combustion mode switching module 106 determines that the operation point stays in the area A3 for a short time. The combustion mode switching module 106 prohibits switching to the lean combustion mode corresponding to the shifted area A3, and continues the stoichiometric combustion mode corresponding to the area A2 before the shift.

The combustion mode switching module 106 outputs signals to the injector 6, the intake-side electric S-VT 23, the exhaust-side electric S-VT 24, the throttle valve 43, the EGR valve 54, and the air bypass valve 48 according to the set combustion mode, to adjust the state function in the combustion chamber 17. That is, the mixture gas is made to or leaner than the stoichiometric air-fuel ratio.

Next, a control related to switching of the combustion mode of the engine executed by the ECU 10 is described with reference to the flowchart of FIG. 9. Note that the order of the steps in the flowchart of FIG. 9 may be changed.

Figure 9:
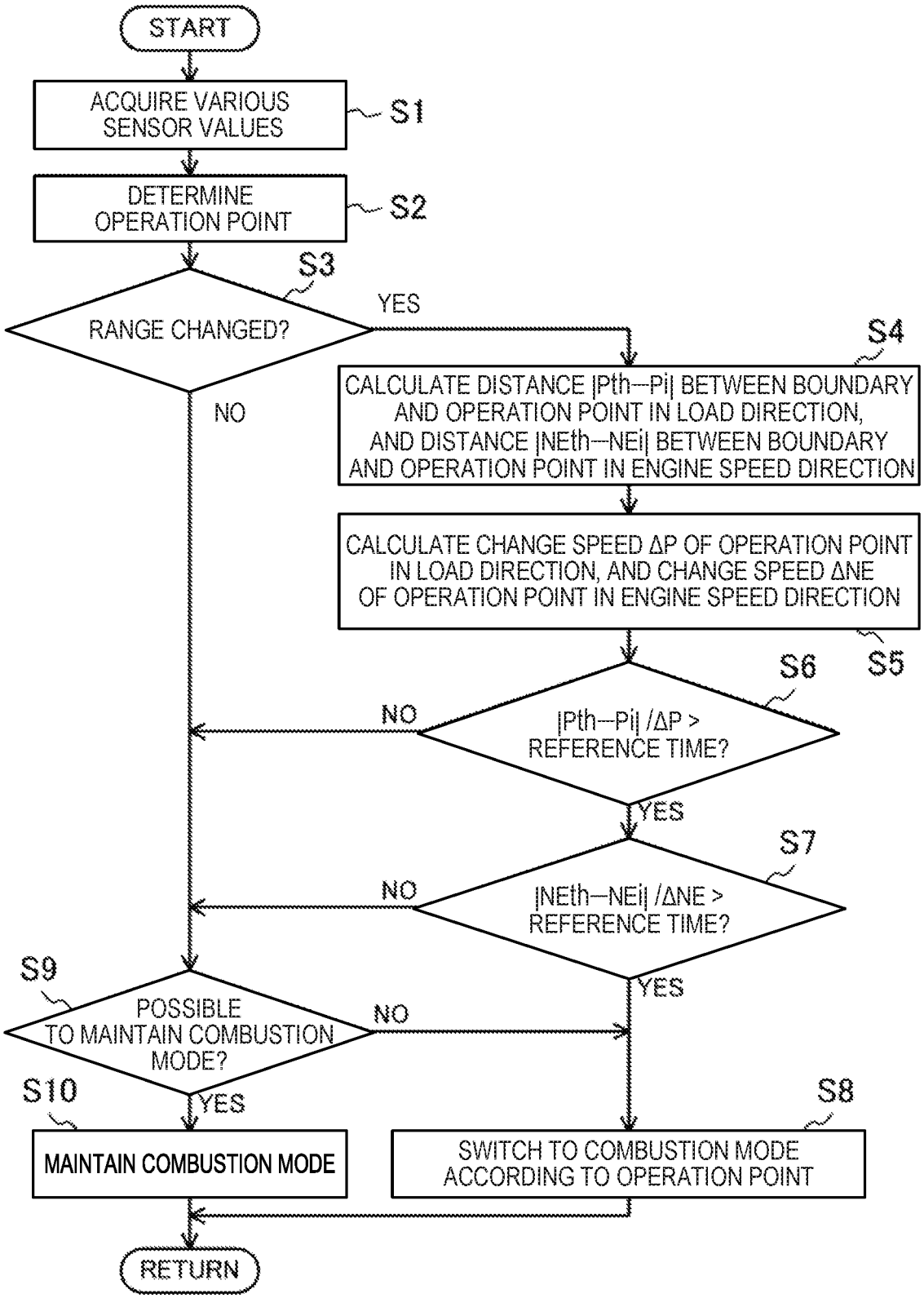
FIG. 9 is a flowchart illustrating a control relating to the switching of the combustion mode of the engine.

At Step S1 of the flowchart of FIG. 9, the ECU 10 reads the signals of the sensors SW1 to SW17, and at a subsequent Step S2, the ECU 10 determines the operation point of the engine 1. At the following Step S3, the shift determining module 104 of the ECU 10 determines whether the area of the operation point of the engine 1 is changed, based on the operation point determined at Step S2 and the operating maps 501 and 502 stored in the memory 102. If the determination at Step S3 is YES, the flow proceeds to Step S4. If the determination is NO, the flow proceeds to Step S9.

At Step S4 for the case where the area is changed, as illustrated in FIG. 7, the predicting module 105 of the ECU 10 calculates the distance |Pth−Pi| between the boundary and the operation point in the load direction, and the distance |NEth−NEi| between the boundary and the operation point in the engine speed direction, on the operation map. As described above, the boundary here is set to L1, L2, N1, or N2, depending on the moving direction of the operation point.

At the following Step S5, the predicting module 105 calculates the change speed ΔP of the operation point in the load direction and the change speed ΔNE of the operation point in the engine speed direction.

Then, at Step S6, the combustion mode switching module 106 determines whether the staying time in the load direction |Pth−Pi|/ΔP is longer than the reference time. If the determination at Step S6 is YES, the flow proceeds to Step S7, otherwise the flow proceeds to Step S9.

At Step S7, the combustion mode switching module 106 determines whether the staying time |NEth−NEi|/ΔNE in the engine speed direction is longer than the reference time. If the determination at Step S7 is YES, the flow proceeds to Step S8, otherwise the flow proceeds to Step S9.

At Step S8, the combustion mode switching module 106 determines that the staying time of the operation point is long, and therefore switches the combustion mode according to the shifted operation point. That is, when the operation point shifts to the area A2, the combustion mode switching module 106 switches the combustion mode to the stoichiometric combustion mode to correspond to the area A2, and when the operation point shifts to the area A3, it switches the combustion mode to the lean combustion mode to correspond to the area A3.

On the other hand, at Step S9, the combustion mode switching module 106 determines whether the combustion mode can be maintained without switching at the operation point. One of the cases where the flow proceeds to Step S9 is when it is determined at Step S3 that the area of the operation point of the engine 1 does not change. In this case, since the area does not change in the first place, the determination at Step S9 is YES, and the flow proceeds to Step S10. The combustion mode switching module 106 does not change the combustion mode.

Further, if the determination at Step S6 or Step S7 described above is NO, the flow also proceeds to Step S9. This occurs in two situations: when the staying time is determined to be short although the operation point shifts from the area A2 to A3; and when the staying time is determined to be short although the operation point shifts from the area A3 to A2.

When the staying time is determined to be short although the operation point shifts from the area A2 to A3, the combustion mode switching module 106 determines whether the stoichiometric combustion mode can be maintained at Step S9. As illustrated in FIG. 6, the operation map 502 is formed by overlapping the first layer 601 and the second layer 602, and the operation point 702 is the operation point of the first layer 601 as well as it is of the second layer 602. At the operation point 702 in the area A3, both the stoichiometric combustion mode and the lean combustion mode can be performed. Therefore, the determination at Step S9 is YES, and the flow proceeds to Step S10. Although the operation point shifts from the area A2 to the area A3, the combustion mode switching module 106 maintains the stoichiometric combustion mode.

On the other hand, when the staying time is determined to be short although the operation point shifts from the area A3 to A2, the combustion mode switching module 106 determines whether the lean combustion mode can be maintained at Step S9. An operation point in the area A2 on the operation map 502 (e.g., operation point 703) is an operation point of the first layer 601, but not of the second layer 602. The lean combustion mode cannot be performed at the operation point in the area A2. Therefore, the determination at Step S9 is NO, and the flow proceeds to Step S8. In this case, the combustion mode switching module 106 switches the combustion mode to the stoichiometric combustion mode.

Accordingly, when the operation point shifts from the area A2 to the area A3, the combustion mode is switched from the stoichiometric combustion mode to the lean combustion mode or continues to be in the stoichiometric combustion mode according to the prediction of the staying time of the operation point in the area A3. Thereby, the operation mode is prevented from switching frequently, and therefore unstable combustion is prevented and also the degradation in fuel efficiency is prevented.

On the other hand, when the operation point shifts from the area A3 to the area A2, the lean combustion mode cannot be performed, therefore the ECU 10 certainly switches the combustion mode to the stoichiometric combustion mode. As a result, the stoichiometric mixture gas can be stably combusted.

Figure 10:
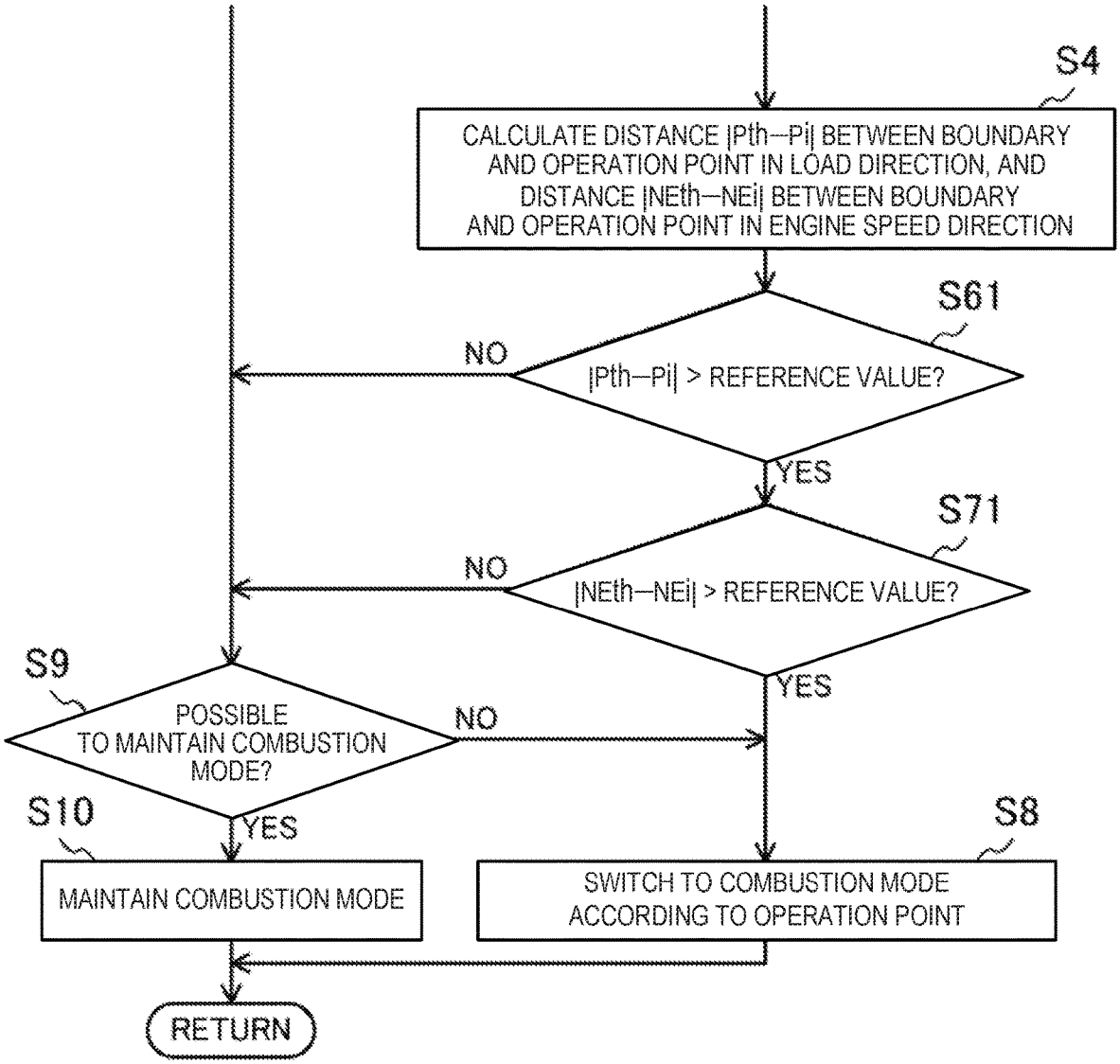
FIG. 10 is a modification of the flowchart of FIG. 9.

In the above configuration, the combustion mode is switched according to the value obtained from the distance and speed (that is, the staying time). However, the combustion mode may be switched according to the distance. FIG. 10 shows a part of the flowchart of the control for switching the combustion mode according to the distance. In the flowchart of FIG. 10, the same steps as those in the flowchart of FIG. 9 are denoted by the same reference characters. In the flowchart of FIG. 10, Step S5 of the flowchart of FIG. 9 is omitted, and Steps S6 and S7 are replaced with Steps S61 and S71, respectively.

At Step S61, the combustion mode switching module 106 determines whether the distance |Pth−Pi| in the load direction is longer than a reference value. If the distance is long, the staying time of the operation point stays is predicted to be long. If the determination at Step S61 is YES, the flow proceeds to Step S71, otherwise the flow proceeds to Step S9.

Similarly, at Step S71, the combustion mode switching module 106 determines whether the distance |NEth−NEi| in the engine speed direction is longer than a reference value. Also in this case, when the distance is long, the staying time of the operation point is predicted to be long. If the determination at Step S71 is YES, the flow progresses to Step S8 to switch the combustion mode, otherwise the flow proceeds to Step S9.

As described above, the length of the staying time can be predicted based on the distance in the load direction and the distance in the engine speed direction. The ECU 10 can appropriately switch the combustion mode based on the distance in the load direction and the distance in the engine speed direction.

Figure 11:
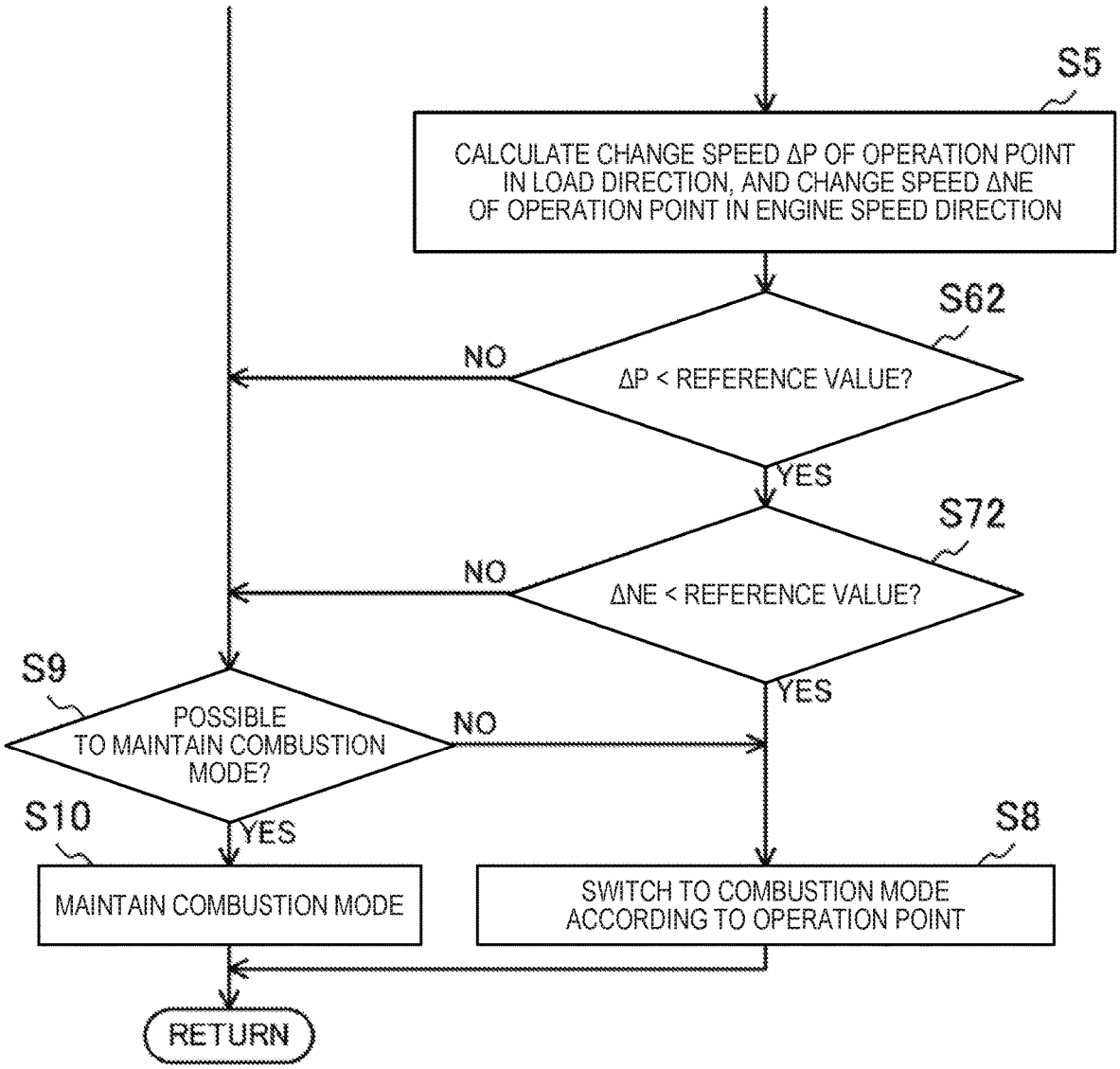
FIG. 11 is a modification of the flowcharts of FIGS. 9 and 10.

FIG. 11 shows a part of the flowchart of the control for switching the combustion mode according to the speed. In the flowchart of FIG. 11, the same steps as those in the flowchart of FIG. 9 are denoted by the same reference characters. In the flowchart of FIG. 11, Step S4 of the flowchart of FIG. 9 is omitted, and Steps S6 and S7 are replaced with Steps S62 and S72, respectively.

At Step S62, the combustion mode switching module 106 determines whether the speed ΔP in the load direction is lower than a reference value. When the speed is low, the staying time in the area of the operation point can be predicted to be long. If the determination at Step S62 is YES, the flow proceeds to Step S72, otherwise the flow proceeds to Step S9.

Similarly, at Step S72, the combustion mode switching module 106 determines whether the speed ΔNE in the engine speed direction is lower than a reference value. Similar to above, when the speed is low, the staying time in the area of the operation point is predicted to be long. If the determination at Step S72 is YES, the flow proceeds to Step S8 to switch the combustion mode, otherwise the flow proceeds to Step S9.

As described above, since the length of the staying time can be predicted based on the speed in the load direction and the speed in the engine speed direction, the ECU 10 can suitably switch the combustion mode based on the speeds in the load direction and in the engine speed direction.

However, on the operation map 502, even if the distances in the load direction and the engine speed direction is long, if the speeds of movement in the load direction and the engine speed direction is high, the time required for the operation point to shift from the second area to the first area may be short. In other words, the staying time may be short.

Conversely, on the operation map 502, even if the distances in the load direction and the engine speed direction are short, if the speeds in the load direction and the engine speed direction are low, the time required for the operation point to shift from the second area to the first area may be long. In other words, the staying time may be long.

As illustrated in FIG. 9, by using both the distance and the speed, it is possible to predict the staying time of the operation point more accurately, which is advantageous in improving fuel efficiency.

Note that the technology disclosed herein is not limited to applying to the engine 1 of the configuration described above. The configuration of the engine 1 may adopt various configurations.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Engine (Internal Combustion Engine)
10 ECU (Controller)
104 Shift Determining Module
105 Predicting Module
106 Combustion Mode Switching Module
SW1 Airflow Sensor
SW2 First Intake-air Temperature Sensor
SW3 First Pressure Sensor
SW4 Second Intake-air Temperature Sensor
SW5 Second Pressure Sensor
SW6 In-cylinder Pressure Sensor
SW7 $NO_x$ Sensor
SW8 Linear $O_2$ Sensor
SW9 Lambda $O_2$ Sensor
SW10 Water Temperature Sensor
SW11 Crank Angle Sensor
SW12 Accelerator Opening Sensor
SW13 Intake Cam Angle Sensor
SW14 Exhaust Cam Angle Sensor
SW15 EGR Pressure Difference Sensor
SW16 Fuel Pressure Sensor
SW17 Third Intake-air Temperature Sensor

What is claimed is:

1. A method for controlling an internal combustion engine, the method comprising:

defining a first area in which the engine operates in a stoichiometric combustion mode and a second area in which the engine operates in a lean combustion mode, on an operation map of the engine defined by an engine load and an engine speed; and causing a controller to:

determine that an operation point of the engine on the operation map shifts from the first area to the second area over a boundary therebetween, based on signals from an accelerator opening sensor and a crank angle sensor;

predict a length of time that the operation point of the engine stays in the second area;

switch a combustion mode of the engine to the lean combustion mode corresponding to the second area when the predicted length of time is longer than a given period of time; and maintain the stoichiometric combustion mode also in the second area when the predicted length of time is shorter than the given period of time, wherein the controller switches the combustion mode to the lean combustion mode when a value obtained by dividing a distance from the operation point of the engine in the second area to the boundary by a speed of the operation point of the engine shifting to the second area over the boundary is greater than a given value on the operation map, and wherein the controller maintains the stoichiometric combustion mode when the value is less than the given value on the operation map.

2. A control device of an internal combustion engine of which a combustion mode is switched between a stoichiometric combustion mode and a lean combustion mode in which the engine operates at a leaner air-fuel ratio than in the stoichiometric combustion mode, the control device comprising:

a sensor configured to output a signal related to the operation of the engine; and a controller configured to receive the signal of the sensor, and cause the engine to operate in one of the stoichiometric combustion mode and the lean combustion mode based on an operation point of the engine determined based on the signal of the sensor, and an operation map, the operation map of the internal combustion engine defined by an engine load and an engine speed, the controller including a processor configured to execute:

a shift determining module to determine that the operation point of the engine on the operation map shifts from a first area on the operation map of the internal combustion engine to a second area on the operation map over a boundary therebetween, based on the signal from the sensor, the first area being an area in which the engine operates in the stoichiometric combustion mode, and the second area being an area in which the engine operates in the lean combustion mode;

a predicting module to predict a length of time that the operation point of the engine stays in the second area; and a combustion mode switching module to, when the predicted length of time is longer than a given period of time, switch a combustion mode of the engine to the lean combustion mode corresponding to the second area, and when the predicted length of time is shorter than the given period of time, maintain the stoichiometric combustion mode corresponding to the first area, without changing to the lean combustion mod;

wherein the predicting module predicts the length of time that the operation point of the engine stays in the second area based on a value obtained by dividing a distance from the operation point of the engine in the second area to the boundary by a speed of the operation point of the engine shifting to the second area over the boundary on the operation map, and wherein the combustion mode switching module switches the combustion mode to the lean combustion mode when the value is greater than a given value, and maintains the stoichiometric combustion mode when the value is less than the given value.

* * * * *